US005697599A

United States Patent [19]

Lamb

[11] Patent Number: 5,697,599

[45] Date of Patent: Dec. 16, 1997

[54] WINCH DEVICE OPERABLE BY 12 VOLT BATTERY CURRENT

[76] Inventor: George K. Lamb, Box 340, Gruver, Tex. 79040

[21] Appl. No.: 515,259

[22] Filed: Aug. 15, 1995

[51] Int. Cl.[6] ..... B66D 1/00

[52] U.S. Cl. ..... 254/328; 254/345; 254/378

[58] Field of Search ..... 254/323, 328, 254/345, 362, 378

[56] References Cited

U.S. PATENT DOCUMENTS

| | | | |
|---|---|---|---|
| 415,823 | 11/1889 | Sharp | 254/345 |
| 1,781,195 | 11/1930 | Ronk | 254/345 X |
| 1,781,700 | 11/1930 | Payne | 254/345 |
| 1,845,171 | 2/1932 | Mendenhall | 254/328 |
| 2,883,013 | 4/1959 | Keith et al. | 254/378 X |
| 3,944,095 | 3/1976 | Brown | 414/24.5 |
| 3,964,621 | 6/1976 | Youngkamp | 414/559 |
| 4,084,708 | 4/1978 | Goodvin | 414/24.6 |
| 4,594,041 | 6/1986 | Hostetler | 414/24.5 |
| 5,281,068 | 1/1994 | Bruce | 414/24.5 |

*Primary Examiner*—Daniel P. Stodola
*Assistant Examiner*—Emmanuel M. Marcelo
*Attorney, Agent, or Firm*—Norman B. Rainer

[57] ABSTRACT

A winch device which may be truck-mounted and operated by the truck's 12 volt electrical system utilizes an automotive starting motor that interacts with a large diameter disc-like gear. A brake drum and a winch drum are coaxially associated with one face of the disc gear. A brake cable is slidably wound upon the brake drum. A brake lever is provided to control the tension upon the brake cable with consequent adjustment of braking force. A tether is spirally wound upon the winch drum.

7 Claims, 1 Drawing Sheet

WINCH DEVICE OPERABLE BY 12 VOLT BATTERY CURRENT

BACKGROUND OF THE INVENTION

1. Field of the Invention

This invention concerns apparatus for performing heavy work in remote locations, and more particularly relates to a winch device which can be operated by the electrical system of an automotive vehicle.

2. Description of the Prior Art

In farming, woodland, construction and other outdoor activities and work projects, it is often necessary to perform heavy work such as lifting bales of hay, operating a squeeze chute for cattle, dragging logs, pulling tree stumps and boulders, extricating a trapped vehicle and elevating building supplies. Such tasks cannot generally be accomplished by the hand power of one or several individuals. In most remote outdoor locations there is no source of high voltage electricity for the operation of high performance power equipment. Although power can be provided in remote locations by internal combustion engines, suitable engines and their accessory equipment are expensive and occupy considerable space in working vehicles which travel to said remote sites.

U.S. Pat. No. 4,084,708 to Goodwin discloses a truck-mounted winch for use in lifting bales of hay. The winch is powered by the truck's electrical system. Because the winch acts upon the extremity of a long lever, little power is demanded of the winch. Also, no brake means are disclosed for securing the work load in a controllable position.

It is accordingly an object of the present invention to provide a winch device operable by 12 volt D.C. current and capable of handling heavy work loads.

It is a further object of this invention to provide a device as in the foregoing object having braking means capable of controllably positioning a work load.

It is another object of the present invention to provide a device of the aforesaid nature of rugged, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a winch device comprising:

a) an automotive starting motor having an output shaft and a small diameter drive gear mounted upon said output shaft, b) a rotating assembly comprising:

1) a circular disc having a centered axle and a toothed circular perimeter engaged by said drive gear, the ratio of the number of teeth on said disc to the number of teeth on said drive gear being between about 12/1 to 25/1, 2) a circular brake drum mounted upon said axle and having a diameter smaller than the diameter of said toothed circular perimeter, said brake drum having an interior face directed toward said disc and an outwardly directed opposite face, and 3) a circular winch drum mounted upon said axle and upon the outwardly directed face of said brake drum and having a diameter smaller than the diameter of said brake drum and less than ⅓ the diameter of said toothed perimeter, c) a brake cable spirally and slideably wrapped about said brake drum and terminating in a first extremity emergent from said brake drum and anchored to a stationary support, and a second extremity emergent from said drum in a direction opposite to the direction of emergence of said first extremity, d) a power transmission tether spirally wound upon said winch drum and having a proximal extremity attached to said drum and a distal extremity freely extending from said drum, e) a brake lever secured by first pivot means to a stationary support and having an extremity which constitutes a handle portion, f) a brake control rod pivotally attached to said handle portion and extending to a distal terminus which secures the second extremity of said brake cable, and g) a tensioned coil spring interactive between the distal terminus of said brake control rod and a stationary support, whereby h) movement of said handle portion in a direction toward said assembly and counter to the rotational direction thereof causes said brake cable to achieve sufficient frictional engagement with said brake drum to halt rotational movement of said assembly, and movement of said handle portion away from said assembly against the urging of said coil spring permits rotation of said assembly in either direction.

In a preferred embodiment, the disc is vertically positioned, and is enclosed within a housing. Said enclosure may also serve as said stationary support.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
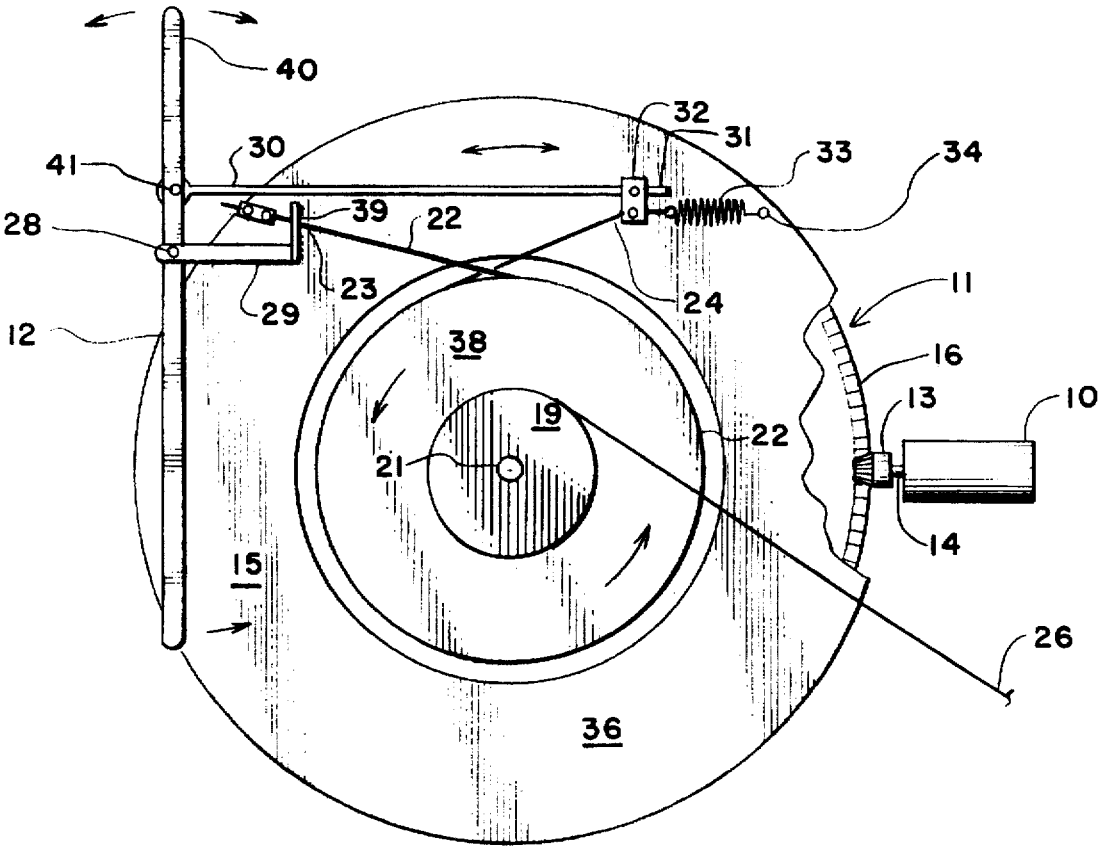
FIG. 1 is a side view of an embodiment of the winch device of the present invention, a portion being broken away to reveal interior details.
Figure 2:
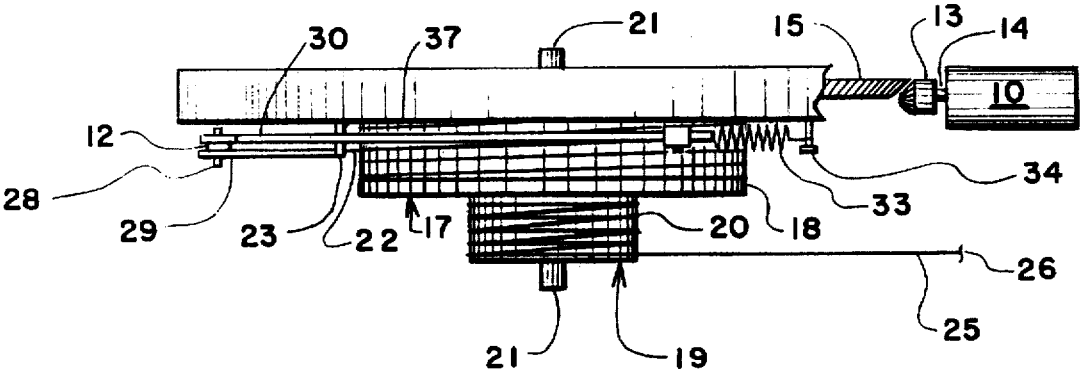
FIG. 2 is a top view of the embodiment of FIG. 1.

Referring to FIGS. 1 and 2, an embodiment of the winch device of the present invention is shown comprised of automotive starting motor 10 interactive with rotating assembly 11 and brake lever 12.

The automotive starting motor is a high torque motor designed to be activated by a 12 volt D.C. electrical source typically employed in trucks and cars. The motor is further designed to have a drive gear 13 which shifts forwardly on output shaft 14 when the motor is started. In its forward position, drive gear 13 is adapted to engage a driven gear such as the flywheel of an automobile starting assembly. When the motor is deactivated, said drive gear retracts away from the driven gear.

Assembly 11 includes a disc 15 shown in a vertically aligned embodiment rotatably mounted upon centered axle 21. Said disc may be the flywheel of an automotive starter system. Disc 15 has a toothed circular perimeter 16 engageable by drive gear 13. The ratio of the number of teeth on said disc to the number of teeth on said drive gear is between about 12/1 to 25/1. By virtue of such a large gear ratio, the starter motor is able to handle heavy workloads. In the illustrated embodiment, the disc is substantially entirely enclosed within stationary housing 36 which is orthogonally penetrated by said axle.

A circular brake drum 17 having a cylindrical shoulder 18 is fixedly mounted upon axle 21 and has a diameter smaller than the diameter of perimeter 16. Said brake drum is further characterized in having an interior face 37 directed toward said housing and outwardly directed face 38.

A circular winch drum 19 having a cylindrical shoulder 20 is fixedly mounted upon axle 21 and against face 38 of said brake drum. Drum 19 has a diameter which is smaller than the diameter of brake drum 17 and less than ⅓ the diameter of perimeter 16.

The several components of assembly 11, namely disc 15, axle 21, and drums 17 and 19 comprise a substantially integral structure which is rotatably mounted upon axle 21 held by a support structure such as housing 36 or other adjacent structure. Such support structure may include a framework located in the cargo compartment of a pick-up truck serving to transport the winch device.

A brake cable 22 is spirally and slideably wrapped upon shoulder 18 of brake drum 17. Cable 22 terminates in a first extremity 23 emergent from shoulder 18 and secured by bracket 39 to a stationary support such as housing 36, and a second extremity 24 emergent from said drum in a direction opposite to the direction of emergence of said first extremity. Cable 22 is preferably of steel construction, having a length and thickness such as to provide between 3 and 5 wraps upon shoulder 18.

A power transmission tether 25 is spirally wound upon shoulder 20 of said winch drum. Tether 25 has a proximal extremity (not shown) which is attached to said drum, and a distal extremity 26 freely extending from said drum. Tether 25 may be constructed of high strength synthetic fiber such as nylon or polyester, and may be in rope or ribbon format. Tether 25 should desirably have a length between about 10 and 30 feet.

A vertically oriented brake lever 12 is secured by first pivot means 28 to a stationary support arm 29 held by bracket 39. The portion of said lever extending above pivot means 28 is a handle portion 40. Pivot means 28 is preferably located adjacent perimeter 16 at an elevation close to the upper extremity of brake drum. 17 By virtue of such arrangement, handle portion 40 is adapted to move toward and away from assembly 11 in a vertical plane adjacent disc 15. A brake control rod 30 is attached by second pivot means 41 to handle portion 40 and extends horizontally to a distal terminus 31. It is to be noted that said second pivot means is spaced from said first pivot means in the direction of handle portion 40. Clamp means 32, adjustably positionable upon rod 30 adjacent terminus 31, secures the second extremity 24 of said brake cable. A tensioned coil spring 33 is interactive between clamp means 32 and post 34 attached to housing 36. The function of spring 33 is to maintain the second extremity of said brake cable in a taut state while applying a controllable constant tension to the cable with attendant control of braking force applied to said brake drum.

In the operation of the winch device, movement of handle portion 40 in a direction toward said assembly and counter to the rotational direction thereof causes said brake cable to achieve sufficient frictional engagement with said brake drum to slow or halt rotational movement of said assembly. The reverse movement of said handle portion permits rotation of said assembly in either direction, as when re-winding tether 25 onto drum 19.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A winch device comprising:

a) an automotive starting motor designed to be activated by 12 volt D.C. current and having an output shaft and a small diameter drive gear mounted upon said output shaft, said drive gear adapted to move on said output shaft away from said motor when the motor is started and return when the motor is deactivated, b) a rotating assembly comprising:

1) a circular disc having a centered axle and a toothed circular perimeter engaged by said drive gear, the ratio of the number of teeth on said disc to the number of teeth on said drive gear being between 12/1 to 25/1, 2) a circular brake drum mounted upon said axle and having a diameter smaller than the diameter of said toothed circular perimeter, said brake drum having an interior face directed toward said disc and an outwardly directed opposite face, and 3) a circular winch drum mounted upon said axle and upon the outwardly directed face of said brake drum and having a diameter smaller than the diameter of said brake drum and less than ⅓ the diameter of said toothed perimeter, c) a brake cable spirally and slideably wrapped about said brake drum and terminating in a first extremity emergent from said brake drum and anchored to a stationary support, and a second extremity emergent from said drum in a direction opposite to the direction of emergence of said first extremity, d) a power transmission tether spirally wound upon said winch drum and having a proximal extremity attached to said drum and a distal extremity freely extending from said drum, e) a brake lever pivotally secured by first pivot means to a stationary support and having a first extremity and a second extremity which constitutes a handle portion, f) a brake control rod pivotally attached by second pivot means to said handle portion and extending to a distal terminus which secures the second extremity of said brake cable, said second pivot means being spaced from said first pivot means in the direction of said handle portion, and g) a tensioned coil spring interactive between the distal terminus of said brake control rod and said stationary support, whereby h) movement of said handle portion in a direction toward said assembly and counter to the rotational direction thereof causes said brake cable to achieve sufficient frictional engagement with said brake drum to halt rotational movement of said assembly, and movement of said handle portion away from said assembly against the urging of said coil spring permits rotation of said assembly in either direction.

2. The device of claim 1 wherein said stationary support is a housing which substantially encloses said disc and is orthogonally penetrated by said axle.

3. The device of claim 1 wherein said disc is vertically oriented.

4. The device of claim 1 wherein said brake cable is of steel construction, having a length and thickness such as to provide between 3 and 5 wraps upon said cylindrical shoulder.

5. The device of claim 1 wherein said tether is constructed of high strength synthetic fiber.

6. The device of claim 1 wherein the handle portion of said brake lever is adapted to move toward and away from said rotating assembly in a plane parallel to and adjacent said disc.

7. The device of claim 1 further comprising clamp means for securing the second extremity of said brake cable, said clamp means being adjustably positionable upon said brake control rod adjacent the distal terminus thereof.

* * * * *